US008901462B2

(12) United States Patent
Lee et al.

(10) Patent No.: US 8,901,462 B2
(45) Date of Patent: Dec. 2, 2014

(54) HEATING UNIT AND METHOD OF MANUFACTURING THE SAME

(75) Inventors: Young Jun Lee, Seoul (KR); Yang Kyeong Kim, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 1298 days.

(21) Appl. No.: 11/830,887

(22) Filed: Jul. 31, 2007

(65) Prior Publication Data

US 2008/0006620 A1 Jan. 10, 2008

(51) Int. Cl.

| | |
|---|---|
| ***H05B 3/40*** | (2006.01) |
| ***H05B 3/08*** | (2006.01) |
| ***H01J 17/18*** | (2012.01) |
| ***H05B 3/00*** | (2006.01) |

(52) U.S. Cl.

CPC ..... *H05B 3/0033* (2013.01); *H05B 3/009* (2013.01)

USPC ..... 219/534; 219/541; 313/623

(58) Field of Classification Search

USPC ..... 219/534, 535, 538, 541–548, 552, 553; 313/110, 111, 623, 624, 625

See application file for complete search history.

(56) References Cited

U.S. PATENT DOCUMENTS

| | | | | |
|---|---|---|---|---|
| 3,189,778 | A * | 6/1965 | Brundige | 313/331 |
| 4,069,437 | A * | 1/1978 | Notelteirs et al. | 313/315 |
| 4,185,219 | A * | 1/1980 | Kamio | 313/279 |
| 6,501,056 | B1 * | 12/2002 | Hirohata et al. | 219/553 |
| 6,654,549 | B1 * | 11/2003 | Konishi | 392/407 |
| 2002/0096984 | A1 * | 7/2002 | Konishi et al. | 313/25 |
| 2003/0209534 | A1 * | 11/2003 | Ferguson | 219/548 |
| 2006/0032847 | A1 * | 2/2006 | Kim et al. | 219/553 |

FOREIGN PATENT DOCUMENTS

| | | |
|---|---|---|
| JP | 2000-113963 | 4/2000 |
| JP | 2005-183377 | 7/2005 |
| KR | 20-0399008 | 10/2005 |

OTHER PUBLICATIONS

Korean Office Action issued in KR Application No. 10-2005-0093826 dated Jul. 28, 2006.

Korean Office Action issued in KR Application No. 10-2005-0063735 dated Nov. 22, 2007.

* cited by examiner

*Primary Examiner* — Sang Y Paik

(74) *Attorney, Agent, or Firm* — KED & Associates, LLP

(57) ABSTRACT

A heating unit and a method of fabricating the heating unit are provided. The heating unit includes a heating member provided in a tube, with an outer surface of the heating member spaced apart from an inner surface of the tube. The heating member may be connected to an external power source by a metal piece, rod, and a connecting unit sequentially coupled to the heating member. The heating member, connecting unit and rod provide a stable positioning of the heating member in the tube during thermal expansion of the heating member, thus preventing contact therebetween.

18 Claims, 20 Drawing Sheets

HEATING UNIT AND METHOD OF MANUFACTURING THE SAME

BACKGROUND

1. Field

This relates to a heating unit and a method of manufacturing the same.

2. Background

Generally, heating units convert energy from an external source into thermal energy. These types of heating units may be used in numerous applications, such as, for example, a cooking device. Heating units may convert electric energy into thermal energy using a filament positioned in a quartz tube and connected to an external power source to generate heat. However, thermal expansion of the filament within the tube may cause damage to the filament and/or the tube, and a reduction in service life of the heating unit.

BRIEF DESCRIPTION OF THE DRAWINGS

The embodiments will be described in detail with reference to the following drawings in which like reference numerals refer to like elements wherein.

DETAILED DESCRIPTION OF THE EMBODIMENTS

Filaments used in heating units may be formed of, for example, carbon and inserted into a central portion of a quartz tube and connected to an external power source by a connecting member. The quartz tube may then be vacuumed or filled with inert gas such as, for example, halogen gas or other inert gas as appropriate, to suppress oxidation of the carbon filament as it is heated.

The carbon filament may have a spiral, plate, or straight shape, or other shape as appropriate. The carbon filament may be connected to an electrode to maintain a predetermined tension so as to avoid contact between the carbon filament and an inner surface of the quartz tube to avoid damage to the quartz tube. For example, the quartz tube may be melted or damaged above certain temperatures, based on a particular composition of the quartz material of the tube, for example, above 800° C. Therefore, over time, as the carbon filament is heated and expands in accordance its heat expansion coefficient, the carbon filament may deform and physically contact the quartz tube, thus damaging the quartz tube. Further, since a diameter of the carbon fiber may be relatively small, it is difficult to bundle the carbon fibers in a spiral shape and meet various electrical requirements such as, for example, a desired resistance of the carbon filament.

Figure 1:
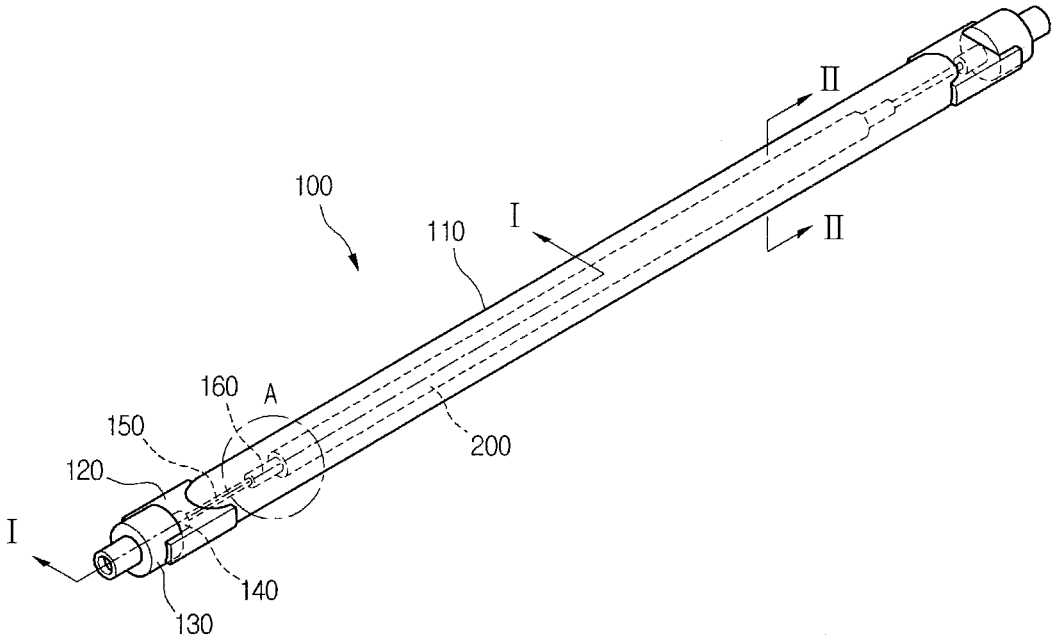
FIG. 1 is a perspective view of a heating unit according to an embodiment as broadly described herein.

Referring to FIG. 1, a heating unit 100 in accordance with a first embodiment may include a tube 110 that defines a receiving space and a heating member 200 provided in the tube 110 to generate heat. The heating unit 100 may also include a rod 150 that supports the heating member 200 and keeps the heating member 200 from contacting the tube 110, and a connecting member 160 that connects the rod 150 to the heating member 200. A metal piece 140 may be connected to a side of the rod 150 to electrically connect an external power source (not shown) to the heating member 200. An insulation unit 130 may insulate the metal piece 140 from an external side of the heating unit 100. A sealing unit 120 may enclose and support the metal piece 140, the insulation unit 130, and the tube 110.

The tube 110 may be formed of a material having a predetermined heat-resistance and strength to sustain the relatively high temperatures to which the heating unit 100 may be heated. For example, the tube 110 may be made of a quartz or other suitable material. In addition, the tube 110 may be sealed to isolate the heating member 200 from the outside. Inert gas may be filled in the tube 110 to prevent the heating member 200 from being deteriorated due to the high temperatures in the tube 110. In this case, the tube 110 may be sealed after the inert gas is filled therein.

The heating member 200 may generate heat from electric energy applied thereto. The heating member 200 may be formed of, for example, a carbon-based material, a tungsten-based material, a nickel/chrome-based alloy, or a combination thereof. Other materials or combinations of materials may also be appropriate, based on the particular application of the heating unit 100 and associated electrical requirements.

When installing the heating member 200 in the tube 110, at least one connecting member 160 provided on at least one end of the heating member 200 may be connected to the rod 150. Then, the heating member 200 may be tensioned to maintain a non-contact state with the tube 110 while maintaining a connection to the external power source to generate heat. In certain embodiments, a connector 160 and rod 150 may be provided at both ends of the heating member 200.

The rod 150 may be connected to the heating member 200 by the connecting member 160 to maintain the tensioned state of the heating member 200. Then, the heating member 200 can generate heat and remain in a stable position, without contacting the tube 100. In certain embodiments, a portion of the rod 150 may extend out of the tube 110 to electrically connect the heating member 200 to the external power source while maintaining the sealed state of the tube 110.

The metal piece 140 may be positioned between the end of the rod 150 that extends out of the tube 110 and the external power source so that electric energy from the external power source can be applied to the heating member 200 via the rod 150. The insulation unit 130 may insulate a portion of the metal piece 140 that is exposed to the outside to prevent current leakage through the metal piece 140. Further, in order to reliably couple the heating unit 100 to a desired receptacle, the insulation unit 130 may be formed in a shape that is compatible with the desired receptacle. The sealing unit 120 may protect the portion of the rod 150 that extends out of the tube 110 and the connecting portion of the metal piece 140. The sealing unit 120 may be assembled with the insulation unit 130 and the tube 100 to support the heating unit 110 and maintain a predetermined shape of the heating unit 100.

Figure 2:
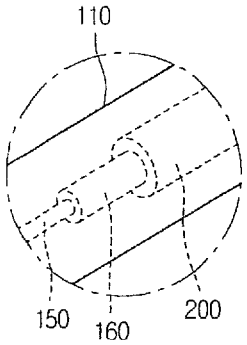
FIG. 2 is an enlarged view of section A of FIG. 1.

As shown in FIG. 2, the heating member 200 may be connected to the rod 150 by the connecting unit 160. In this embodiment, the heating member 200 is formed in a hollow pipe shape and the connecting unit 160 is inserted in the hollow portion of the heating member 200. Therefore, the supporting force provided by the rod 150 can be transferred to the heating unit 200 via the connecting unit 160. As a result, the heating unit 200 can generate heat without deforming and contacting the tube 110 due to the support provided by the connecting unit 160 and the rod 150.

Figure 3:
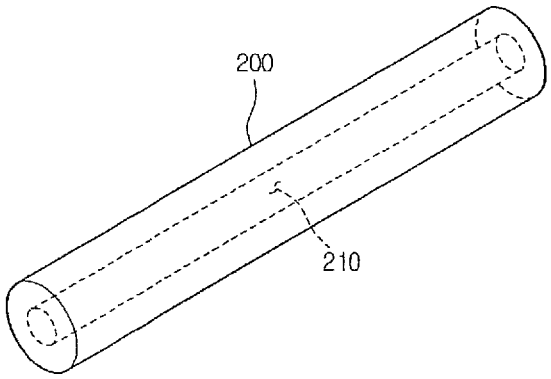
FIG. 3 is a perspective view of a heating member of the heating unit shown in FIG. 1.

Referring to FIG. 3, the heating member 200 formed in the hollow pipe shape extends to a predetermined length. The connecting member 160 may be inserted into a hole 210 extending through the heating member 200. Since the heating member 200 is formed in a pipe shape, the heating member 200 itself also provides a certain amount of rigidity.

Accordingly, when the heating member 200 generates heat, deformation of the heating member 200 may be significantly reduced. By adjusting a structural characteristic of the heating member 200 by adjusting such as, for example, a diameter of the heating member 200, the heating member 200 may have electrical properties corresponding to desired electrical requirements. In addition, the heating member 200 may have a uniform cross section along its length so as to be more easily fabricated.

In certain embodiments, the cross sectional shape of the heating member 200 may correspond to that of the tube 110. That is, since a variety of parts including the heating member 200 are disposed in the tube 110, the inside of the tube 110 is hollow to receive parts. In this embodiment, the cross section of the tube 110 is ring-shaped, and the inside of the heating member 200 is also hollow. Therefore, the heating member 200 can be positioned in the tube 110 and spaced apart from the tube 110 by a predetermined distance to avoid contact between the heating member 200 and the tube 110.

Figure 4:
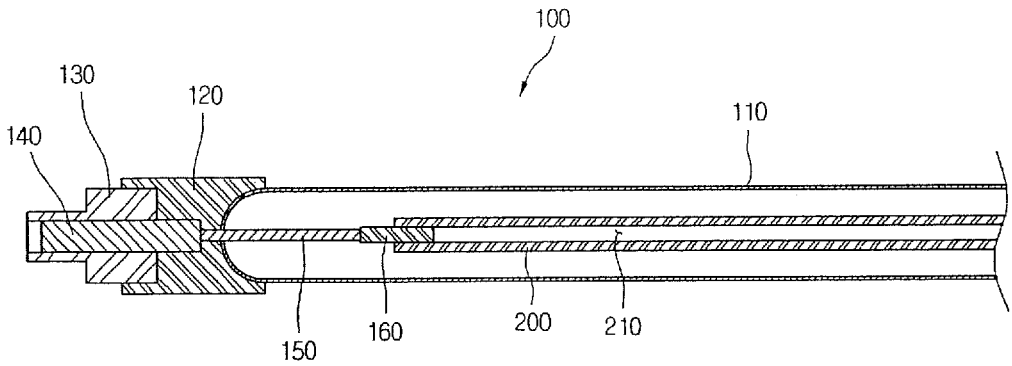
FIG. 4 is a sectional view taken along line I-I of FIG. 1.

As shown in FIG. 4, the tube 110, the heating member 200 disposed in the tube 110, and the connecting unit 160, rod 150, and the metal piece 140 may be sequentially connected to the heating member 200. The metal piece 140 may be insulated by the insulation unit 130, and the insulation unit 130 and the tube 110 may be enclosed by the sealing unit 120 to define a predetermined shape. The connecting unit 160 may be inserted into the hole 210 extending through the heating member 200 and may be connected to the rod 150 to transfer a supporting force to the heating member 200 and electrically connect the external power source to the heating member 200. In certain embodiments, the connecting member 160 may be force fit into the hole 210 of the heating member 200 to form a reliable coupling.

In the embodiment shown in FIG. 4, the connecting portion 160 extends only partially into the hole 210 in the heating member 200. However, in alternative embodiments, a length of the connecting member 160 may be adjusted so that it extends further into the hole 210, or all the way through the hole 210 to the opposite end of the heating member 200.

Figure 5:
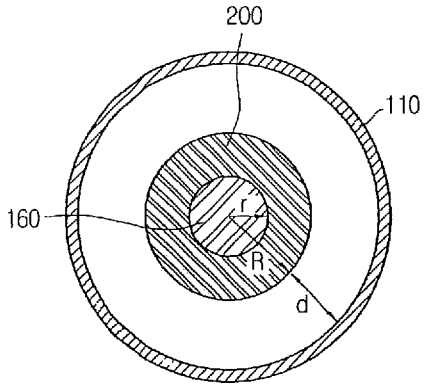
FIG. 5 is a sectional view taken along line II-II of FIG. 1.

As shown in FIG. 5, an outer surface of the heating member 200 may be spaced apart from an inner surface of the tube 110 by a predetermined distance d so as to prevent contact between the heating member 200 and the tube 110. A radius from a center of the heating unit 100 to the inner surface of the heating member 200 may be defined as an inner radius r, and a radius from the center of the heating unit 100 to the outer surface of the heating member 200 may be defined as an outer radius R. In this case, the heating member 200 may have a predetermined cross section due to a difference between the inner radius r and outer radius R. Because heat is generated between the inner and outer radii r and R of the heating member 200, the cross section of the heating member 200 may be one factor that determines a calorific value of the heating member 200.

By adjusting a cross section of the heating member 200, the heating member 200 may be designed to have a desired calorific value. For example, in this embodiment, by adjusting the inner and/or outer radius r and R as necessary, the calorific value of the heating member 200 can be adjusted. In this embodiment, since the inner radius r of the heating member 200 is associated with the connecting unit 160, the adjustment of the calorific value can be achieved more easily by adjusting the outer radius R of the heating member 200.

As described above, when the heating member 200 is designed to have a desired calorific value and desired electrical properties by adjusting a cross section of the heating member 200, the heating member 200 can be more easily fabricated when compared to a heating member formed by weaving strands. Furthermore, the calorific value and electrical properties can be more easily adjusted.

The above-described heating unit 100 may have numerous applications, such as, for example, in a cooking device. If the heating unit 100 is used in a cooking device and the heating temperature of the heating unit 100 is too low, it takes a long time to cook food. When the heating temperature of the heating unit 100 is too high, an outer portion of the food may be burned before any heat is transmitted to an inner portion of the food. Further, energy efficiency is deteriorated when the calorific value of the heating unit 100 is not effectively transferred. Therefore, in order to optimally cook the food and maximize the energy efficiency, the heating member 200 may be, for example, a carbon heater.

Figure 6:
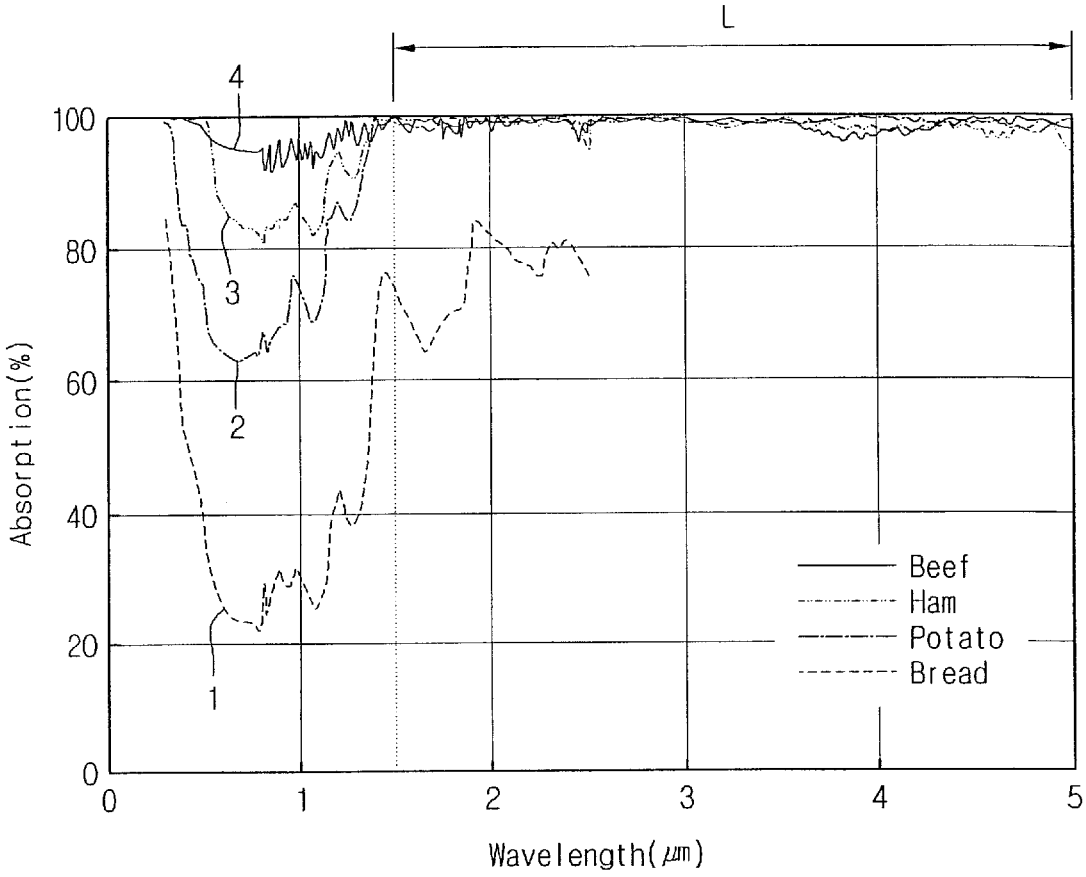
FIG. 6 is a radiance absorption graph.

FIG. 6 is a radiance absorption graph (1) for processed food such as bread, (2) for non-processed food such as cereal, (3) for processed meat such as ham, and (4) for non-processed meat such as beef. As shown by the radiance absorption graphs (1), (2), (3), and (4), when a wavelength of the radiance is 1.4-5 μm, (hereinafter, referred to as "maximum absorption range L") the radiance is fully absorbed in the food.

That is, light having a wavelength of the maximum absorption range L is more effectively absorbed in the food as a whole while the light outside this range is not absorbed in the food, but instead either reflected or not typically used for cooking food. The graphs shown in FIG. 6 are measured by a fourier transform infrared spectroscopy (FI-IR). The FI-IR is a method for measuring an absorption spectrum of infrared rays. That is, by analyzing the wavelength of the absorbed light, a relative intensity of the radiance absorbed in food can be determined.

According to the above description, it can be noted that a heating unit that can generate radiance having a wavelength within the maximum absorption range L (1.4-5 μm) would be optimal for use in a cooking device. By selecting such an optimal heating unit, a relatively large amount of the radiance generated by the heating unit may be absorbed in the food, while an amount of radiance that is not used for cooking, and may thus be wasted, may be reduced. As a result, power consumption can also be reduced.

Figure 7:
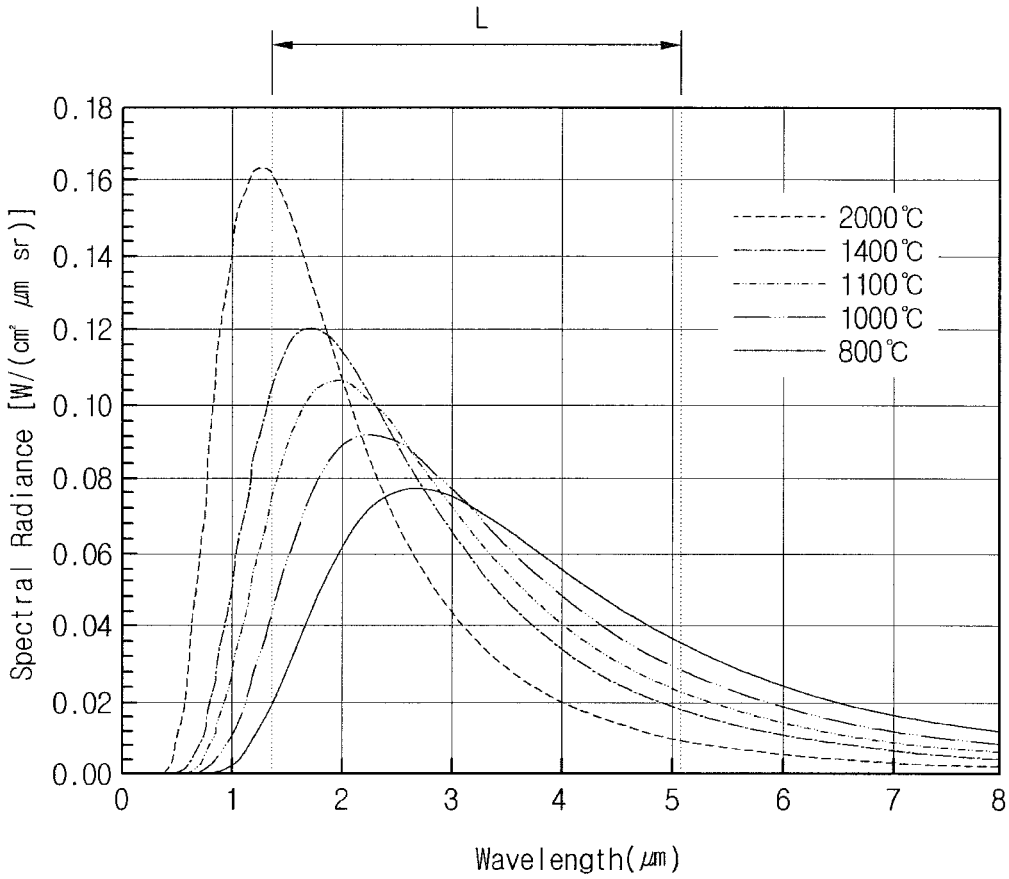
FIG. 7 is a graph of a relative intensity of radiance at different wavelengths for varying temperatures of an exemplary blackbody.

Referring to FIG. 7, the lowermost curve illustrates a case where a temperature of a blackbody is lowest, and the uppermost curve illustrates a case where the temperature of the blackbody is highest. The temperature of the blackbody at which a largest amount of the radiance is emitted at wavelengths within the maximum absorption range L (1.4-5 μm) is about 1100-1400° C. Therefore, the blackbody provides the "optimum radiance range" within the temperature range. When the temperature of the blackbody is lower than 1100° C., a large amount of radiance is radiated at wavelengths higher than 5 μm. When the temperature of the blackbody is higher than 1400° C., a large amount of radiance is radiated at wavelengths lower than 1.4 μm. Therefore, it is advantageous that a heating unit radiate within the optimal radiance range. That is, in case of food, it is advantageous that a heating unit emit a largest amount of radiance at a wavelength of 1.4-5 μm, and particularly, that can emit radiance within the optimum radiance range.

Given the above conditions, a variety of electric heaters including a halogen heater, a ceramic heater, a sheath heater, and a carbon heater were tested. Each of the heaters has a predetermined temperature range within which the heater may be appropriately used. For example, the sheath heater may be appropriately used at a temperature of about 800° C., and the ceramic heater may be appropriately used at a temperature of about 1000° C. The halogen heater may be appropriately used at a temperature of about 2000° C., and the carbon heater may be appropriately used at a temperature of about 1200° C. Use of these heaters at temperatures above the appropriate temperature damage to the heater and/or increases in power consumption.

Among these heaters, only the carbon heater has an operating temperature (1200° C.) within the optimum radiance range L. A graph representing a relative intensity of the radiances of these heaters is shown in FIG. 8.

Figure 8:
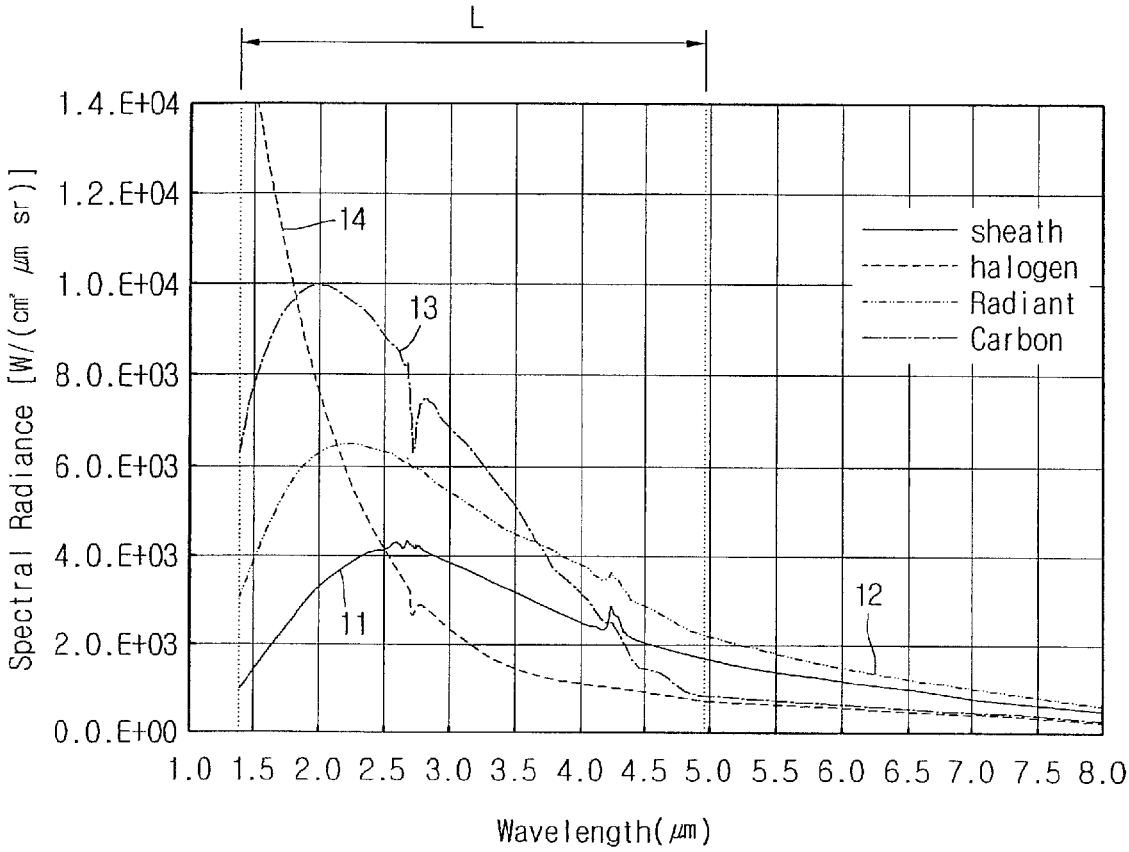
FIG. 8 is a graph of a relative intensity of radiance of different types of electric heaters.

The graph shown in FIG. 8 includes a radiance graph 11 of the sheath heater, a radiance graph 12 of the ceramic heater, a radiance graph 13 of the carbon heater, and a radiance graph 14 of the halogen heater. These graphs 11-14 show that the carbon heater provides the optimum radiance range and radiates the largest amount of radiance at wavelengths of 1.4-5 μm. The wavelength range can be represented as a temperature of 1100-1400° C. That is, the carbon heater radiates a largest amount of calories within this temperature range.

Based on this, it may be assumed that the optimal radiance range can be obtained by the carbon heater, and a significant amount of the calorific value produced by the carbon heater may be absorbed by food being cooked. Thus, the carbon heater may be effectively applied to a cooking device.

When the cooling device is an electric oven, light emitted by the carbon heater may be directly applied to the food, and the carbon heater can be used as the optimal electric heater for the cooking device. However, when the cooking device is a hot plate, and a shielding member, such as, for example, a glass ceramic material, is provided between the carbon heater and the food, radiance transmittance through the glass ceramic material becomes an important factor. In order to verify this, each heater was tested to measure a light transmittance through an appropriate glass ceramic material.

Figure 9:
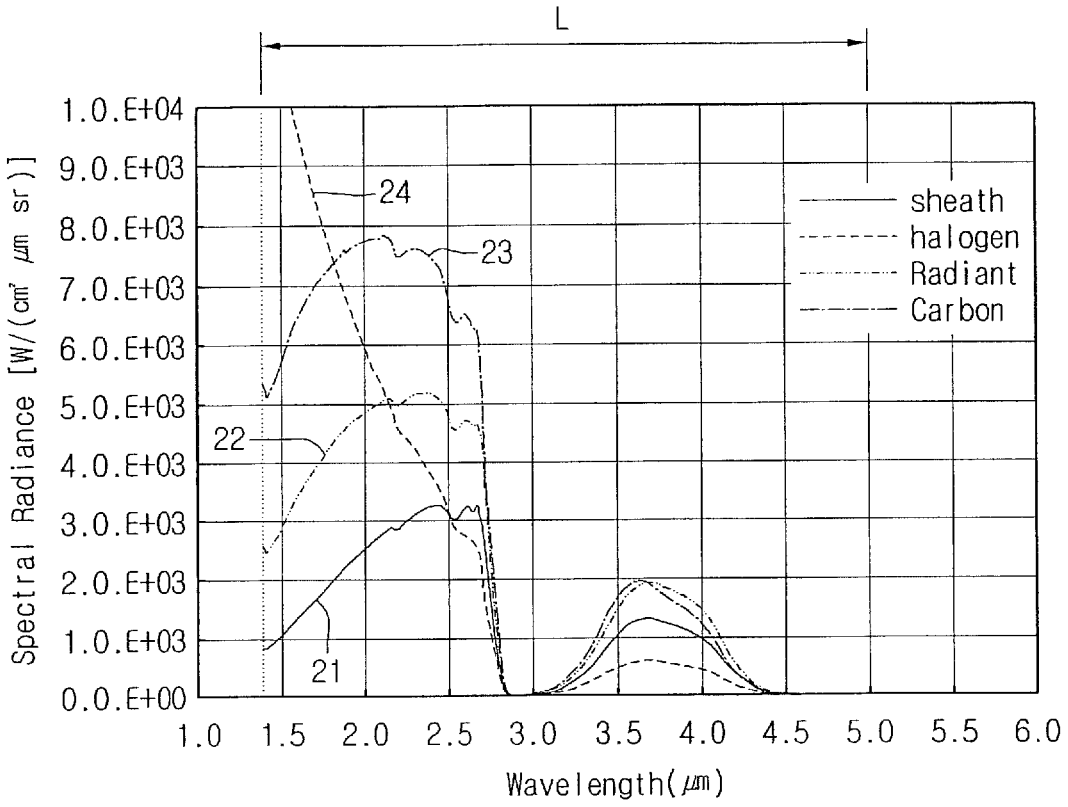
FIG. 9 is a graph of light transmittance of the different types of electric heaters.

The graph shown in FIG. 9 includes a radiance transmittance graph 21 of the sheath heater, a radiance transmittance graph 22 of the ceramic heater, a radiance transmittance graph 23 of the carbon heater, and a radiance transmittance graph 24 of the halogen heater. Since the radiance transmittance of the sheath and ceramic heaters is lower than that of the carbon heater, the sheath and ceramic heaters may not be appropriate for use in a hot plate. Although the transmittance of the halogen heater through the glass ceramic material is relatively high, since the relative intensity of the radiance at the maximum absorption range is weak, the actual radiance absorbed by the food is weak. Thus, the halogen heater is not appropriate for use in a hot plate. Thus, the carbon heater may be most appropriate for a hot plate.

When a carbon heater is used as the heating unit 100, the heating member 200 may include a first heating member having a first thermal expansion coefficient and a second heating member having a second thermal expansion coefficient. In certain embodiments, the second thermal expansion coefficient may be less than the first thermal expansion coefficient. The first heating member may be formed of carbon, and the second heating member may be formed of, for example, tungsten or a nickel/chrome-based alloy.

Figure 10:
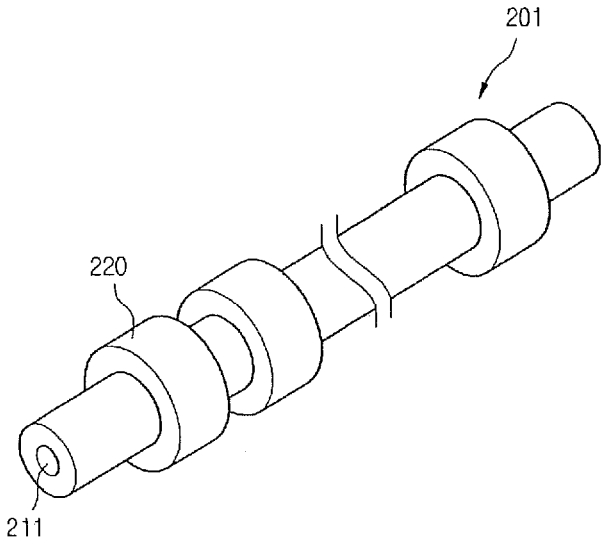
FIG. 10 is a perspective view of a heating member of a heating unit according to another embodiment as broadly described herein.

FIG. 10 is a perspective view of a heating member of a heating unit according to a second embodiment as broadly described herein. This embodiment may include a heating member 201 provided with a hole 211 into which a connecting unit 160 may be inserted. The heating member 201 may have at least one sub-heating portion 220. In certain embodiments, a cross section of the sub-heating portion 220 is larger than other portions of the heating member 201. Therefore, the sub-heating portion 220 may have a calorific value greater than those of other portions of the heating member 201.

The sub-heating portion 220 may be integrally formed with an outer circumference of the heating member 210 by enlarging an outer diameter of the heating member 201 at predetermined portion(s) thereof. A number of sub-heating portions 220 may be determined based on a desired increase in calorific value. Further, in order to prevent the heating member 201 from contacting a tube 110 in which it is positioned, an outer surface of the sub-heating portion 220 may be spaced apart from the tube 110 by a predetermined distance.

Figure 11:
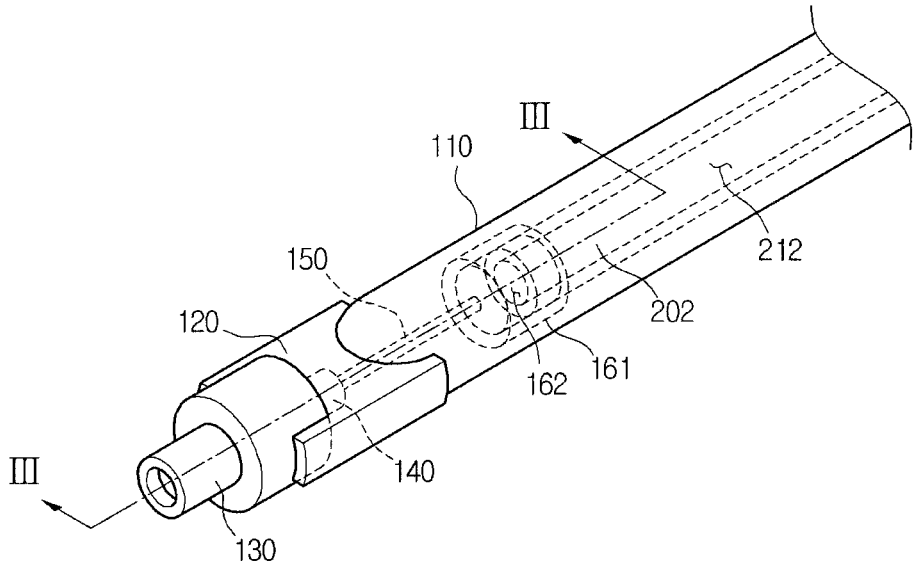
FIG. 11 is a perspective view of a heating unit according to another embodiment as broadly described herein.
Figure 12:
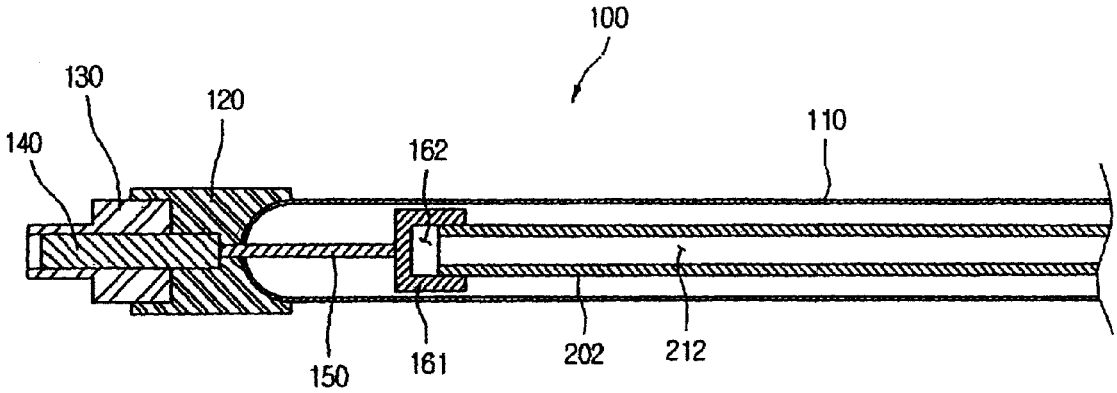
FIG. 12 is a sectional view taken along line III-III of FIG. 11.

As shown in FIG. 11, a heating unit 100 in accordance with a third embodiment may include a connecting unit 161 connected to a rod 150 and a heating member 202 coupled to the connecting unit 161 disposed within a tube 110. The heating member 202 may be provided with a hole 212. A hole 162 may be formed in the connecting unit 161, and the heating member 202 may be inserted into the hole 162 to couple the connecting unit 161 to the heating member 202. As shown in FIG. 12, an end of the rod 150 may be connected to a metal piece 140 so as to apply electric power to the heating member 202 through the connecting unit 161. These parts may be insulated and supported by an insulation unit 130 and a sealing unit 120.

In this embodiment, the heating member 202 may be inserted into the hole 162 of the connecting unit 161 such that an inner surface of the connecting unit 161, which defines the hole 162, faces an outer surface of the heating member 202. By the above-described structure, the heating member 202 may be supported by the connecting unit 161. Therefore, when the heating member 202 generates heat and expands, contact between the heating member 202 and the tube 110 may be prevented by support provided by the connecting unit 161 to the heating member 202.

The heating unit 202 may have a hollow pipe shape. Therefore, since the heating member 202 itself has a certain amount of rigidity, supporting force for preventing the heating member 202 from contacting the tube 110 may be further increased. As a result, when the heating member 202 generates heat and expands, contact between the heating member 202 and the tube 110 may be further prevented. To further prevent the heating member 202 from contacting the tube 110, the heating member 202 may be uniformly spaced apart from the tube 110. Therefore, the hole 162 of the connecting unit 161, in which the heating member 202 is inserted, may be formed along a central axis of the connecting unit 161.

In the above embodiments, the heating member 202 may be inserted into the connecting unit 161 or the connecting unit 161 may be inserted into the heating member 202. However, numerous other modifications and embodiments that ultimately provide the desired coupling and connection therebetween may also be appropriate.

Figure 13:
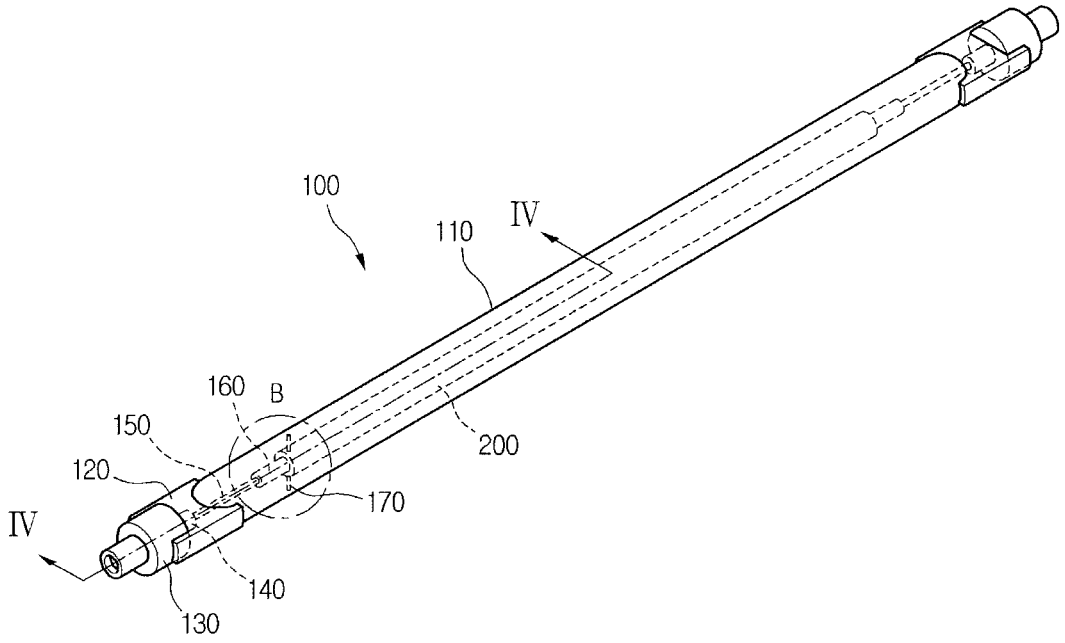
FIG. 13 is a perspective view of a heating unit according to another embodiment as broadly described herein.

FIG. 13 is a perspective view of a heating unit according to a fourth embodiment as broadly described herein.

Figure 14:
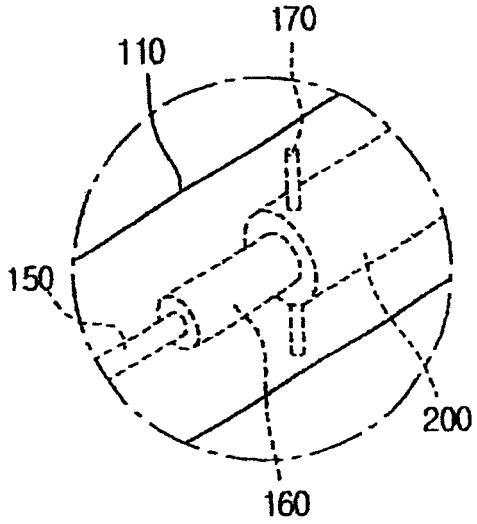
FIG. 14 is an enlarged view of section B of FIG. 13.

As shown in FIGS. 13 and 14, a heating member 200 that can generate heat from electric power applied thereto may be disposed in a tube 110. The heating member 200 may be connected to an external power source by a metal piece 140, a rod 150, and a connecting unit 160. One end of the connecting unit 160 may be inserted into the heating member 200 and the other end may be connected to the rod 150. In this embodiment, a fixing member 170 may securely couple the heating member 200 to the connecting unit 160.

Figure 15:
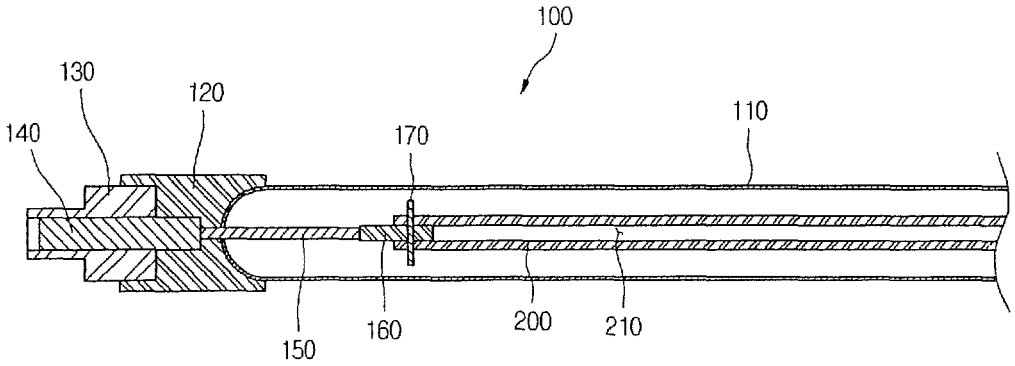
FIG. 15 is a sectional view taken along IV-IV of FIG. 13.

As shown in FIG. 15, the connecting unit 160 connected to the rod 150 may be inserted into the hole 210 of the heating member 200. The fixing member 170 may have a pin-shape and may be coupled to a portion of the heating member 200 into which the connecting unit 160 is inserted. The fixing member 170 may penetrate the heating member 200 and the connecting unit 160 to fix the heating member 200 to the connecting unit 160. In this structure, the heating member 200 may be more securely coupled to the connecting unit 160. Then, the supporting force transferred through the rod 150 may be reliably transferred to the connecting unit 160 and the heating member 200, and contact between the tube 110 and the heating member 200 may be prevented.

Figure 16:
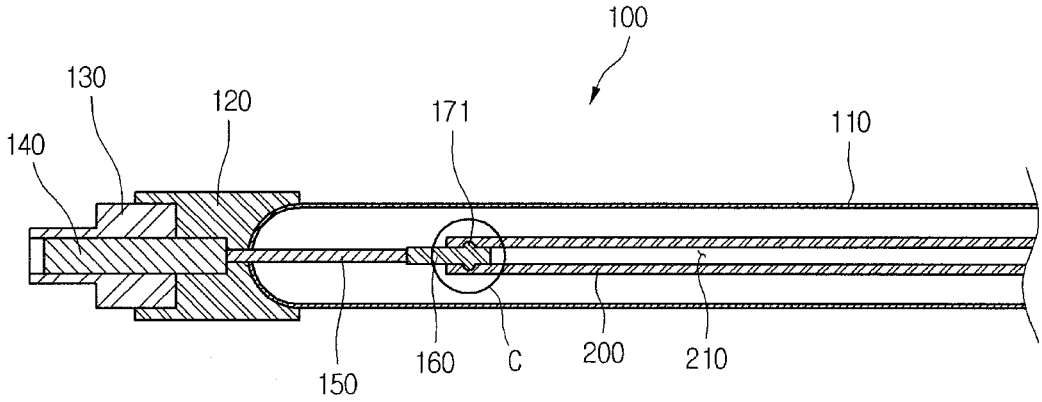
FIG. 16 is a sectional view of a heating unit according to another embodiment as broadly described herein.
Figure 17:
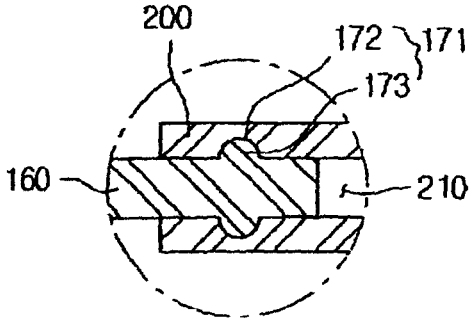
FIG. 17 is an enlarged view of section C of FIG. 16.

FIG. 16 is a sectional view of a heating unit according to a fifth embodiment as broadly described herein. As shown in FIGS. 16 and 17, a heating member 200 with a hole 210 may be disposed in a tube 110. A connecting unit 160 may be inserted into the hole 210, and a fixing unit may securely couple the connecting unit 160 to the heating member 200. In this embodiment, the fixing unit may include a protrusion/depression portion 171 that corresponds to an outer surface of the connecting unit 160 and an inner surface of the heating member 200. In more detail, protrusions 173 may be formed on the outer surface of the connecting unit 160 and corresponding depressions 172 may be formed on the inner surface of the heating member 200. The arrangement of the depressions 172 and protrusions 173 may be reversed. By this structure, the coupling of the heating member 200 to the connecting unit 160 may be secured and the connection of the heating member 200 to the external power source may be established.

In the above embodiments, the fixing unit fixes the connecting unit 160 in the heating member 200. However, the fixing unit may be applied to other embodiments to fix the insertion of the heating member 200 in the connecting unit 160.

Figure 18:
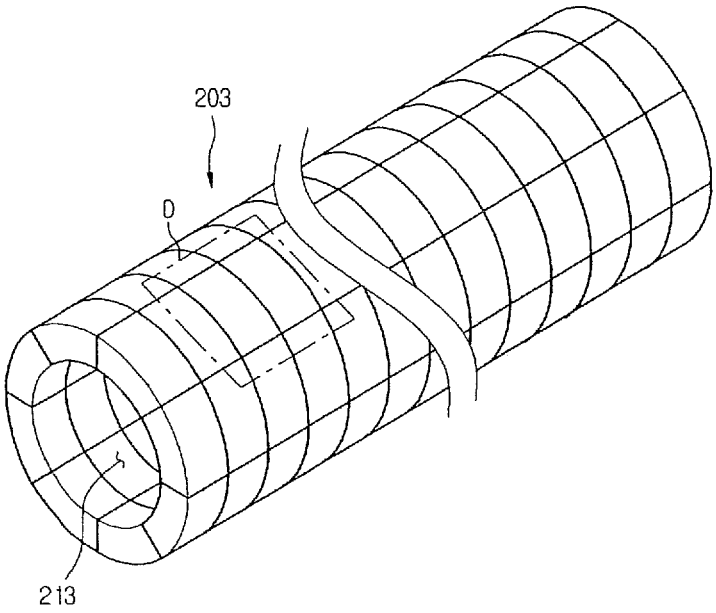
FIG. 18 is a perspective view of a heating member of a heating unit according to another embodiment as broadly described herein.

FIG. 18 is a perspective view of a heating member of a heating unit according to a sixth embodiment as broadly described herein. In this embodiment, a heating member 203 including a hole 213 may be formed of woven strands. The heating member 203 may be formed by one of satin, twill, plain, leno, fancy gauze weaves and the like. After weaving, the woven material may be rolled in a pipe shape having a circular cross section so that it can be effectively inserted into a tube 110 having a circular cross section. In certain embodiments, the circular cross section of the heating member 203 may increase its calorific value.

Figure 19:
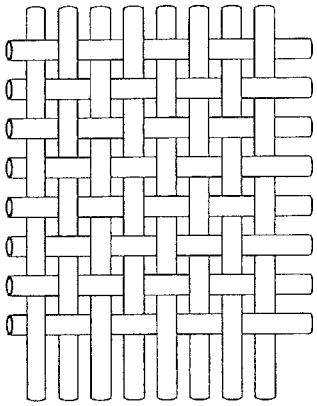
FIGS. 19-23 are enlarged views of section D of FIG. 18, in accordance with embodiments as broadly described herein.

FIG. 19 is an enlarged view of section D of FIG. 18, in which the heating member 203 is formed by a plain weave. In a plain weave, the warp and weft may be aligned so that they form a simple crisscross pattern.

Figure 20:
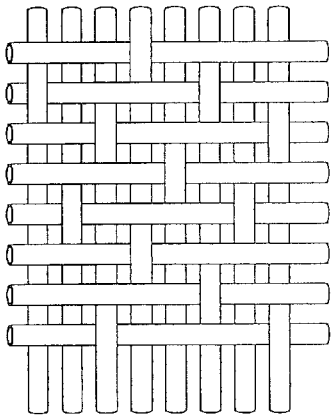

FIG. 20 is an enlarged view of section D of FIG. 18, in which a heating member 203 in accordance with this embodiment is formed by a satin weave. In a satin weave, many warps and wefts are visible on a surface of the heating member 203.

Figure 21:
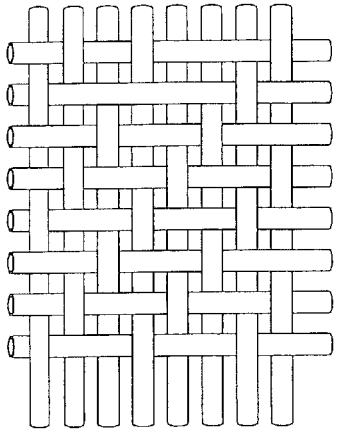

FIG. 21 is an enlarged view of section D of FIG. 18, in which a heating member 203 in accordance with this embodiment is formed by a twill weave. In a twill weave, the warps and wefts form a ridge pattern.

Figure 22:
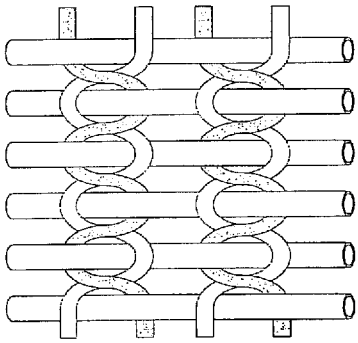

FIG. 22 is an enlarged view of section D of FIG. 18, in which a heating member 203 in accordance with this embodiment is formed by a leno gauze weave. In a leno gauze weave, the warps and wefts are twisted.

Figure 23:
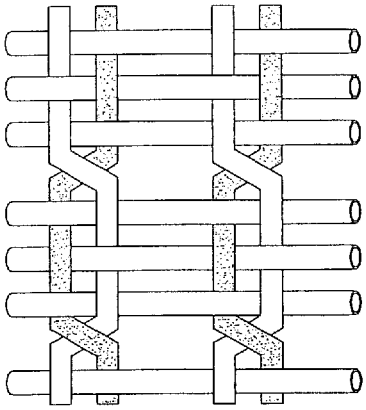

FIG. 23 is an enlarged view of section D of FIG. 18, in which a heating member 203 in accordance with this embodiment is formed by a fancy gauze weave. A fancy gauze weave is a combination of the plain weave and the leno gauze weave. In a fancy gauze weave, two strands of weft is twisted with at least three strands of warp.

As described above, when the heating member 203 is formed by weaving strands, electrical properties such as, for example, resistance of the heating member 203, may be established and adjusted as necessary by adjusting, for example, a diameter of each strand and a weaving density. Therefore, by adjusting the diameter of each strand and the weaving density, the heating member 203 may be designed to produce the desired electrical properties.

The various embodiments of the heating unit as broadly described herein may be easily applied to a variety of different types of devices that require localized heating. For example, heating units as embodied and broadly described herein may be applied to cooking devices as shown in FIGS. 24 and 25.

Figure 24:
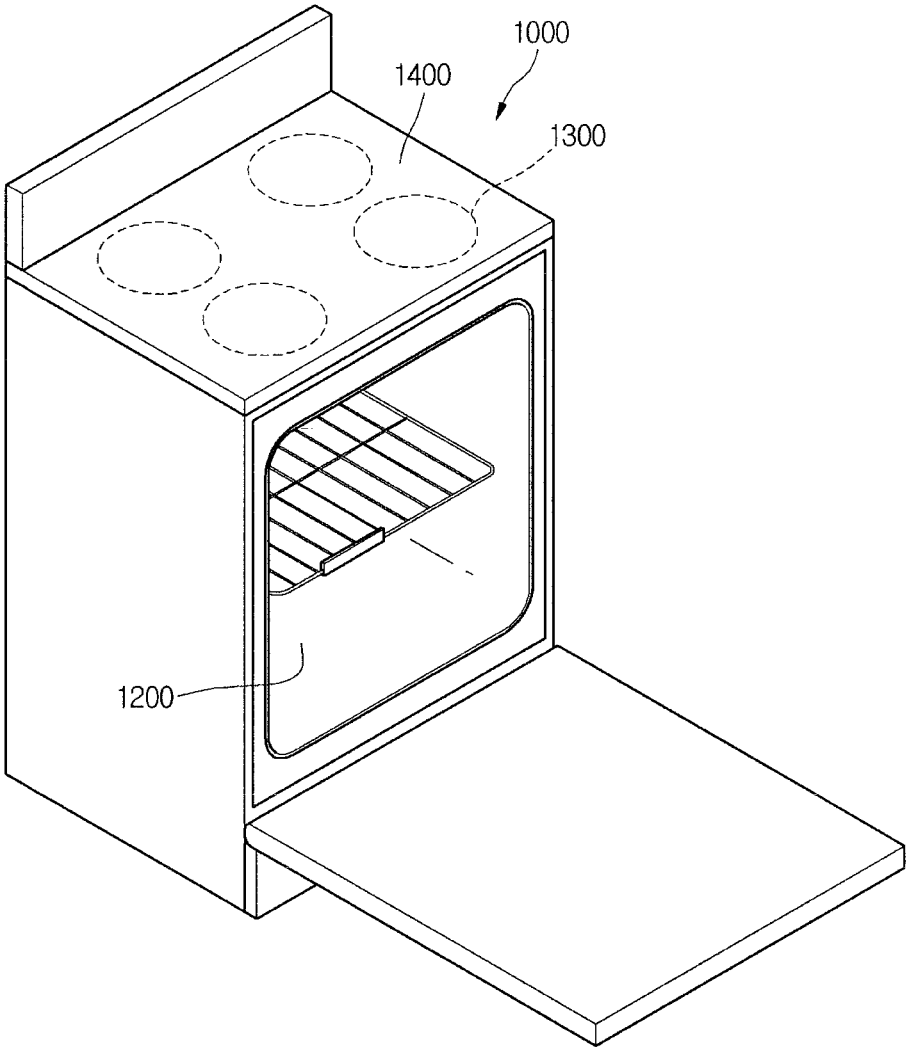
FIGS. 24 and 25 illustrate exemplary cooking devices including one or more heating units as embodied and broadly described herein.

More specifically, FIG. 24 shows a cooling device in the form of a range 1000. The range 1000 may include a cook top, or hot plate 1100, and a cooking cavity 1200. The hot plate 1100 may include one or more heating units 1300 as embodied and broadly described herein covered by a ceramic glass material 1400 such that heat generated by the one or more heating units 1300 is radiated through the ceramic glass material 1400 to heat food positioned on the hot plate 1100. The cooking cavity 1200 may also include one or more heating units 1300 as embodied and broadly described herein such that heat generated by the one or more heating units 1300 heats food positioned in the cooking cavity 1200. Installation and functionality of ranges is discussed in detail in U.S. Pat. Nos. 7,060,940, 7,189,950 and 6,549,818, the entirety of which are incorporated herein by reference.

Figure 25:
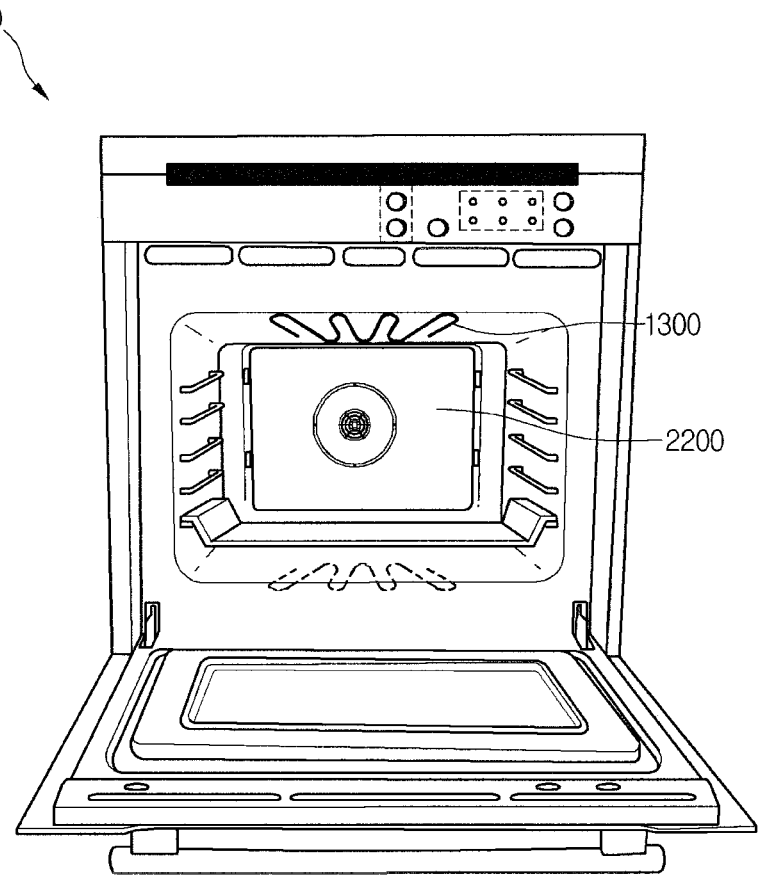

FIG. 25 shows another such cooking device in the form of a combination microwave/convection oven 2000. The microwave/convection oven 2000 may include a cooking cavity 2200, and one or more heating units 1300 as embodied and broadly described herein may generate heat to heat food positioned in the cooking cavity 2200. Installation and functionality of combination microwave/convection ovens is discussed in detail in U.S. Pat. Nos. 6,392,211, 5,756,974 and 6,987,252, the entirety of which are incorporated herein by reference.

A heating unit is provided that can reliably prevent a heating member from contacting a tube enclosing the heating member, and a method of fabricating the heating unit.

A heating unit is provided that has a heating member that is designed in response to the electrical requirements such as resistance of a heating member, and a method of fabricating the heating unit.

In one embodiment, a heating unit includes a tube, and a heating member shaped in a hollow pipe, the heating member being in the tube.

In another embodiment, a heating unit includes a tube, and a heating member shaped in a hollow pipe, the heating member being in the tube, wherein one of inner and outer diameters of the heating member is adjusted to correspond to a desired calorific value.

In still another embodiment, a heating unit includes a tube, a heating member shaped in a hollow pipe, the heating member being in the tube, and a connecting unit provided with a hole and connecting the heating member to an external power source, wherein the heating member is inserted in the hole of the connecting unit.

In another embodiment, a heating unit includes a tube, and a heating member in the tube, the heating member being formed by weaving strands.

In another embodiment, a method of fabricating a heating unit including a tube and a heating member in the tube includes forming the heating member in a hollow pipe shape, and adjusting one of inner and outer diameters of the heating member so that the heating member has a desired calorific value.

In another embodiment, a method of fabricating a heating unit including a tube and a heating member in the tube, wherein the heating member is formed by weaving strands.

By forming the heating member in a hollow pipe shape and inserting the connecting member into the hollow portion of the heating member, the supporting force may be transmitted from lead rod and to the heating member.

Therefore, since the heating member generates heat without contacting the tube, the damage of the heating member and the tube, which is caused by the contacting of the heating member with the tube, can be prevented. As a result, the service life of the heating unit can increase.

Further, by forming the heating member in a pipe shape, the heating member has a predetermined rigidity itself. Therefore, when the heating member generates heat, the deformation of the heating member may be reduced. Therefore, the contacting of the heating member with the tube can be prevented and thus the service life of the heating unit can increase.

Further, by adjusting a cross section of the heating member, the heating member can have a desired calorific value. Fabrication of the heating member may be simplified compared to fabrication by tangling the carbon fibers. In addition, it is easy to adjust the electrical property such as the calorific value.

Furthermore, since the heating member is formed by weaving strands, the electrical property such as the resistance of the heating member can be determined in accordance with a diameter of the strand and the weaving density. Therefore, by adjusting the diameter of each of the strands and the weaving density, desired electric requirements and desired electrical property of the heating member can be easily realized.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heating unit, comprising:

a tube;

a heating member positioned in the tube, wherein the heating member has a substantially cylindrical shape with a passage extending at least partially therethrough along a longitudinal axis thereof;

a rod having a first end thereof that receives power from an external power source; and a cylindrical connector having a first end thereof inserted into the passage formed in the heating member such that the heating member surrounds the first end of the connector, with an outer circumferential surface of the first end of the connector contacting a corresponding inner circumferential surface of the passage to couple the first end of the connector to a corresponding end of the heating member, and a second end thereof coupled to a second end of the rod, wherein external power is applied to the heating member through the rod and the connector, wherein the second end of the rod is received within the second end of the connector such that an outer circumferential surface of the rod contacts a corresponding inner circumferential surface of the second end of the connector.

2. The heating unit of claim 1, wherein a cross-section of the tube is ring-shaped and a cross-section of the heating member is ring-shaped.

3. The heating unit of claim 2, wherein an outer circumference of the heating member and an inner circumference of the tube are separated by a predetermined distance.

4. The heating unit of claim 1, wherein the passage extends continuously from a first end to a second end of the heating member.

5. The heating unit of claim 1, further comprising a metal piece coupled to the first end of the rod, and an insulator and a seal coupled to the metal piece and the first end of the rod, wherein external power is transmitted to the rod through the metal piece.

6. The heating unit of claim 1, wherein the corresponding end of the heating member at least partially surrounds the first end of the connector.

7. The heating unit of claim 1, further comprising a fixing member that secures the first end of the connector to the corresponding end of the heating member.

8. The heating unit of claim 7, wherein the fixing member comprises a pin that extends through the connector and the heating member to fix a relative position thereof.

9. The heating unit of claim 7, wherein the fixing member comprises a protrusion and a corresponding recess respectively formed on confronting surfaces of the connector and the heating member, wherein the protrusion is received in the recess so as to fix a relative position of the heating member and the connector.

10. The heating unit of claim 1, further comprising a sub-heating portion provided on the heating member, wherein a cross sectional area of the healing member where the sub-heating member is formed is greater than that of other portions of the heating member.

11. The heating unit of claim 10, wherein an outer diameter of the sub-heating portion is greater than an outer diameter of the heating member.

12. The heating unit of claim 11, wherein the sub-heating portion is integrally formed on an outer circumference of the heating member.

13. The heating unit of claim 1, wherein an adjustment in at least one of an inner or an outer diameter of the heating member yields a corresponding adjustment in a calorific value output by the heating member.

14. The heating unit of claim 13, wherein the outer diameter of the heating member is adjusted to yield a desired calorific value output by the heating member.

15. The heating unit of claim 1, wherein the heating member comprises a plurality of woven strands.

16. The heating unit of claim 15, wherein the plurality of woven strands are woven in one of a satin pattern, a twill pattern, a plain pattern, a leno gauze pattern, or a fancy gauze pattern.

17. The heating unit of claim 15, wherein an adjustment in at least one of a diameter of each of the plurality of strands or a weave density yields a corresponding adjustment in electrical properties provided by the heating member.

18. A cooking device comprising the heating unit of claim 1.

* * * * *